United States Patent [19]

Fairbanks

[11] Patent Number: 5,045,010

[45] Date of Patent: Sep. 3, 1991

[54] METHOD OF ASSEMBLYING A TENSIONED SHADOW MASK AND SUPPORT FRAME

[75] Inventor: David W. Fairbanks, South Brunswick Township, Middlesex County, N.J.

[73] Assignee: RCA Licensing Corporation, Princeton, N.J.

[21] Appl. No.: 556,143

[22] Filed: Jul. 23, 1990

[51] Int. Cl.[5] ..... H01J 9/00

[52] U.S. Cl. ..... 445/30; 29/449

[58] Field of Search ..... 445/30; 29/449, 448

[56] References Cited

U.S. PATENT DOCUMENTS 4,333,034 6/1982 Ohgoshi et al. ..... 313/407

4,495,437 1/1985 Kume et al. ..... 313/403

*Primary Examiner*—Kenneth J. Ramsey

*Attorney, Agent, or Firm*—Joseph S. Tripoli; Dennis H. Irlbeck

[57] ABSTRACT

The present invention provides an improved method of assemblying a rectangular tensioned shadow mask wherein the two long sides are welded to two curved frame members paralleling the major axis. The improvement comprises forming two subassemblies of said frame, each subassembly including one of the curved members and two partial straight members, each partial straight member being attached at 90 degrees to an end of the curved member. Next, the two subassemblies are positioned in approximately their final positions with the partial straight members on each side of the frame overlapping each other but forming an angle less than 180 degrees on the side of the frame of the intended mask attachment. The long sides of the mask are next welded to the curved members. Now, the subassemblies are rotated until the partial straight members are aligned, to apply tension to the two curved members to place at least a central portion of the shadow mask under a predetermined tension. Next, pressure is applied to the ends of one of the curved members in a direction away from the other curved member to place at least the side portions of the shadow mask under the predetermined tension. Finally, the partial straight members are welded together where they overlap to form complete straight members extending between the curved members.

2 Claims, 3 Drawing Sheets

METHOD OF ASSEMBLYING A TENSIONED SHADOW MASK AND SUPPORT FRAME

This invention relates to shadow masks for use in color picture tubes, and particularly to a method of assemblying a shadow mask to a support frame to attain a desired tension in the mask.

BACKGROUND OF THE INVENTION

A color picture tube includes an electron gun for forming and directing three electron beams to a screen of the tube. The screen is located on the inner surface of a faceplate of the tube and is made up of an array of elements of three different color emitting phosphors. An apertured mask, called a shadow mask, is interposed between the gun and the screen to permit each electron beam to strike only the phosphor elements associated with that beam. A shadow mask is a thin sheet of metal, such as steel, that is contoured to somewhat parallel the inner surface of the tube faceplate.

One type of color picture tube has a cylindrical faceplate and a tensioned shadow mask mounted therein. The typical material used for these tensioned shadow mask is about 7 mils thick. In order to maintain the tension on the mask, the mask must be attached to a relatively massive support frame. Although these prior tubes have found wide consumer acceptance, there is still a need for further improvement in tube types having cylindrical faceplates to reduce the weight and cost of the mask-frame assemblies in such tubes.

SUMMARY OF THE INVENTION

The present invention provides an improved method of assemblying a tensioned shadow mask and support frame. The mask is rectangular having two long sides paralleling a central major axis thereof and two short sides paralleling a central minor axis thereof. The frame has two curved members paralleling the major axis and two straight members paralleling the minor axis. The two long sides of the mask are welded to the curved members. The improvement comprises forming two subassemblies of said frame, each subassembly including one of the curved members and two partial straight members, each partial straight member being attached to an end of the curved member. Next, the two subassemblies are clamped in approximately their final positions with respect to each other and with the partial straight members on each side of the frame overlapping each other. The subassemblies are then rotated to form an angle between the overlapped partial straight members, the angle being less than 180 degrees on the side of the frame of the intended mask attachment. The mask is now positioned on the frame with the long sides of the mask being on the curved members. The long sides of the mask are next welded to the curved members. Now, the subassemblies are rotated in a direction opposite to the first rotation, to apply tension to the two curved members to place at least a central portion of the shadow mask under a predetermined tension. Next, pressure is applied to the ends of one of the curved members in a direction away from the other curved member to place at least the side portions of the shadow mask under the predetermined tension. Finally, the partial straight members are welded together where they overlap to form complete straight members extending between the curved members.

DETAILED DESCRIPTION OF THE PREFERRED EMBODIMENTS

Figure 1:
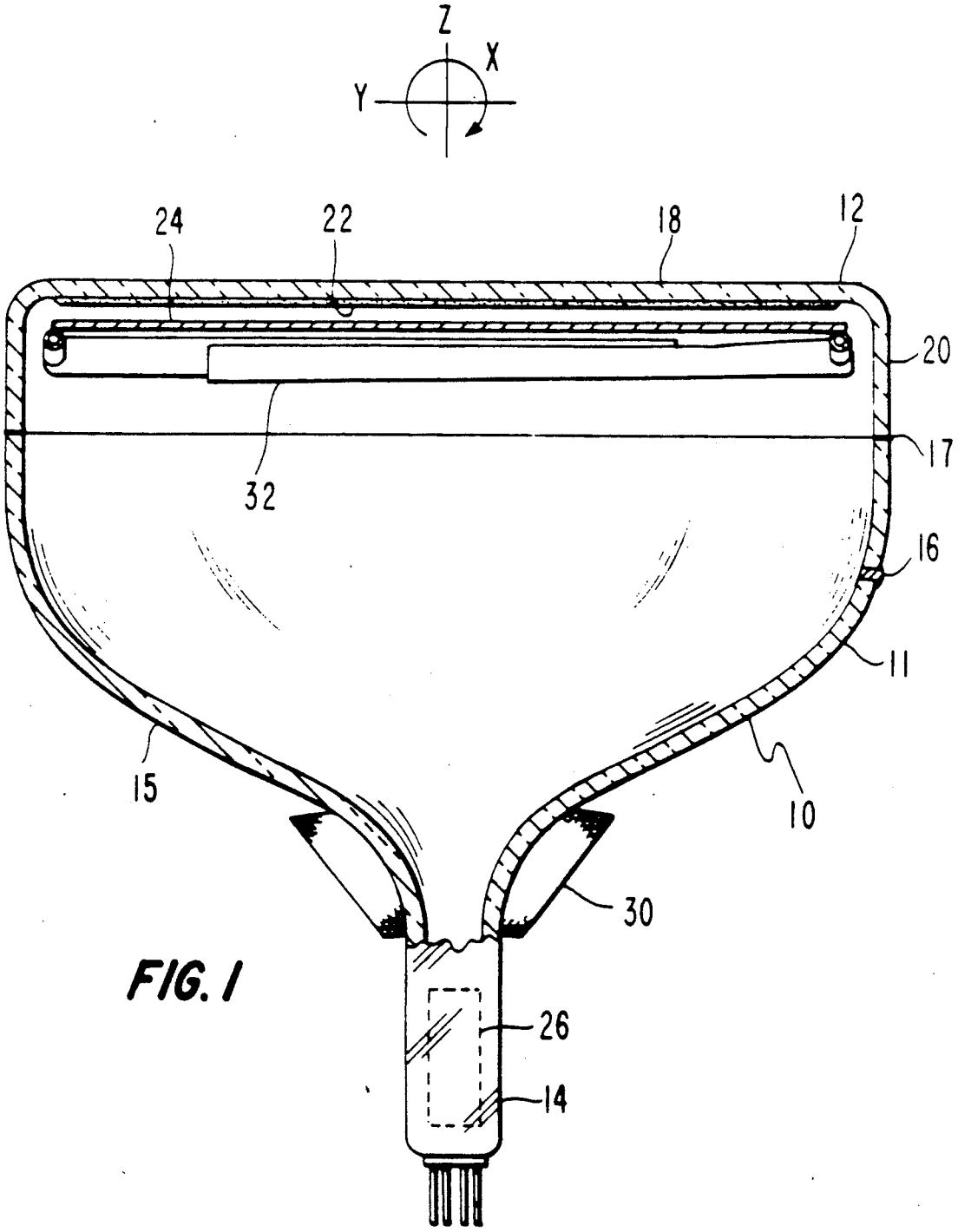
FIG. 1 is a plan view, partly in axial section, of a color picture tube embodying the invention.

FIG. 1 shows a cathode-ray tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a cylindrical viewing faceplate 18 and a peripheral flange or sidewall 20 which is sealed to the funnel 15 by a glass frit 17. A three-color phosphor screen 22 is carried by the inner surface of the faceplate 18. The screen 22 is a line screen with the phosphor lines arranged in triads, each triad including a phosphor line of each of the three colors. A cylindrical multi-apertured color selection electrode or shadow mask 24 is removably mounted in predetermined spaced relation to the screen 22. An electron gun 26, shown schematically by dashed lines in FIG. 1, is centrally mounted within the neck 14 to generate and direct three inline electron beams, a center beam and two side or outer beams, along convergent paths through the mask 24 to the screen 22.

The tube of FIG. 1 is designed to be used with an external magnetic deflection yoke, such as the yoke 30 shown in the neighborhood of the funnel-to-neck junction. When activated, the yoke 30 subjects the three beams to magnetic fields which cause the beams to scan horizontally and vertically in a rectangular raster over the screen 22.

The shadow mask 24 is a thin rectangular sheet of metal, preferably 2 mil (0.05 mm) thick AK steel, that includes two long sides and two short sides. The two long sides of the mask parallel a central major axis, X, of the mask and the two short side parallel a central minor axis, Y, of the mask. The mask includes an apertured portion that contains a multiplicity of elongate slits that parallel the minor axis of the mask. Each slit extends from near one long side of the mask to near the other long side.

Figure 2:
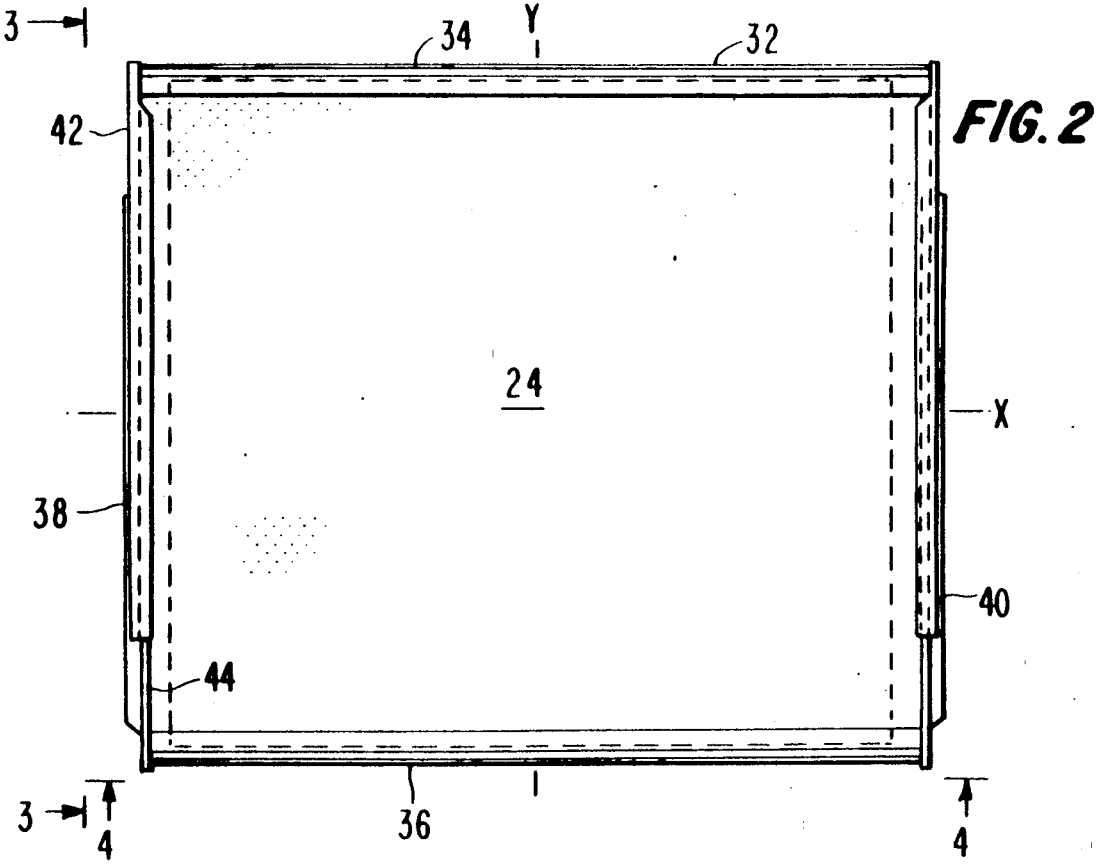
FIG. 2 is a plan view of a tensioned shadow mask-mask frame assembly.
Figure 4:
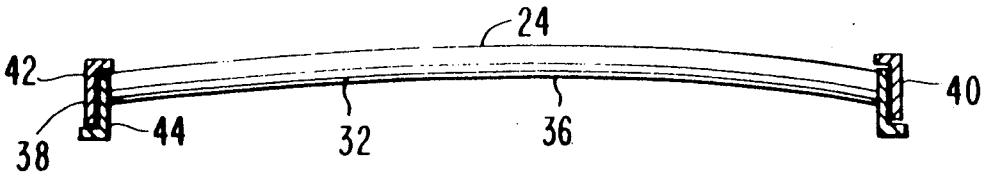
FIG. 4 is a front view of the mask-frame assembly taken at line 4—4 of FIG. 2.
Figure 3:
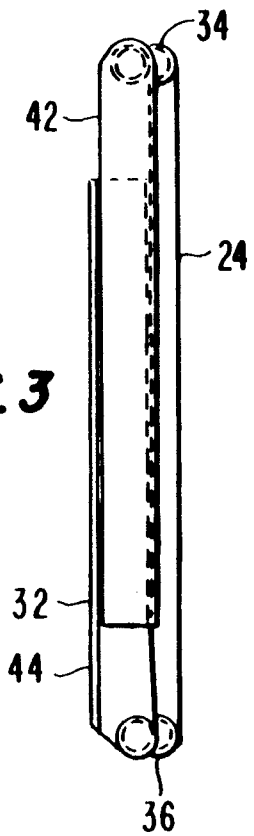
FIG. 3 is a side view of the mask-frame assembly taken at line 3—3 of FIG. 2.

A frame 32, for use with the shadow mask, is shown in FIGS. 2, 3 and 4. The frame 32 includes four major members, two torsion tubes or curved members 34 and 36 and two tension arms or straight members 38 and 40. The two curved members, 34 and 36, are hollow tubes which parallel the major axis X and each other. Each straight member 38 and 40 includes two overlapped partial members or parts 42 and 44, each part having an L-shaped cross-section. The overlapped parts 42 and 44 are welded together where they are overlapped An end of each of the parts 42 and 44 is attached to an end of one of the curved members The curvature of the curved members 34 and 36 matches the cylindrical curvature of the shadow mask 24. The long sides of the mask 24 are welded between the two curved members 34 and 36.

In one preferred embodiment, the curved members 34 and 36 are hollow tubes having a 0.750 inch (1.905 cm) outer diameter and a wall thickness of 0.093 inch (0.236 cm). The parts 42 and 44 of the straight members 38 and 40 are 0.093 inch (0.236 cm) thick and their L-shapes have a vertical dimension of 1.00 inch (2.54 cm) and a horizontal dimension of 0.125 inch (0.318 cm).

Figure 5:
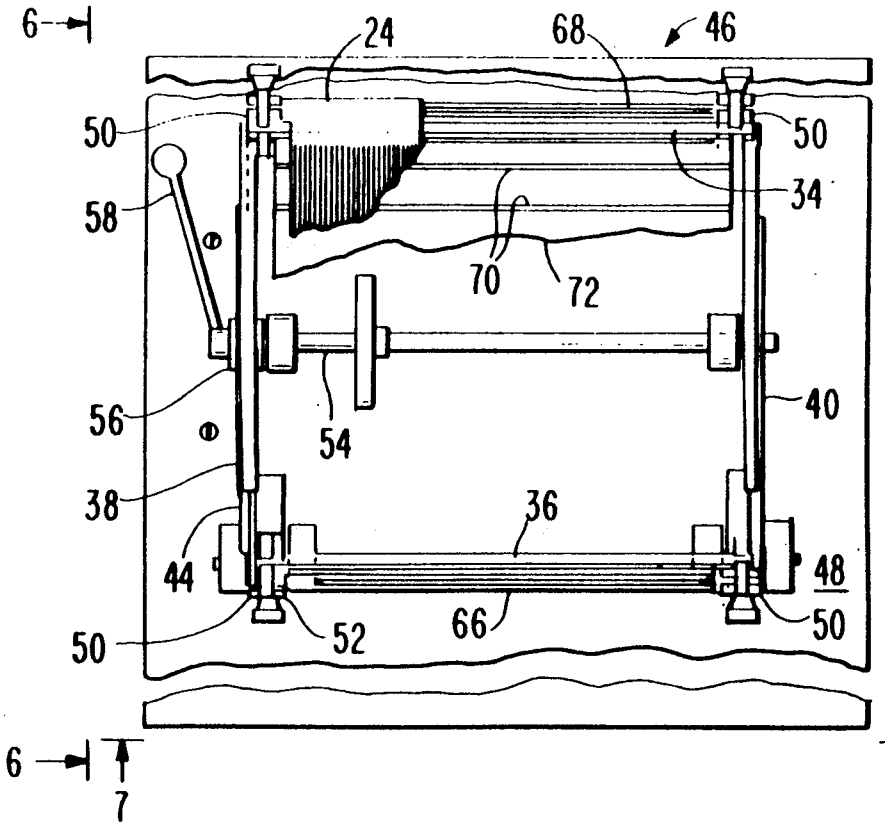
FIG. 5 is a plan view of a fixture used in fabricating the mask-frame assembly of FIG. 2.
Figure 6:
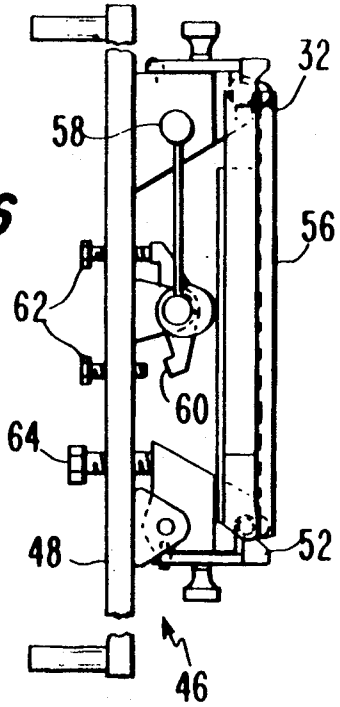
FIG. 6 is a side view of the fabrication fixture, with a portion removed, taken at line 6—6 of FIG. 5.
Figure 7:
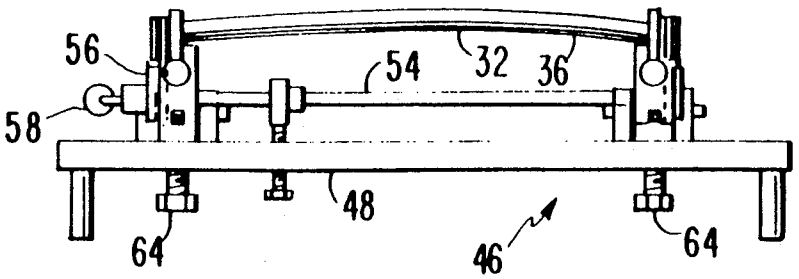
FIG. 7 is a front view of the fabrication fixture, with a portion removed, taken at line 7—7 of FIG. 5.

FIGS. 5, 6 and 7 show a fixture 46 used for assemblying the mask 24 and the frame 32. The fixture 46 includes a baseplate 48 to which various components are attached. Four supports 50 are located on the base at positions at the four corners of a rectangle These supports 50 hold the two curved members 34 and 36 near their attachment points with the straight members 38 and 40. Each support 50 includes a clamp 52 that engages a curved member When the clamps are loosened, they permit insertion of the curved members in the supports and, when tightened, they hold the curved members but permit some rotation of the curved members. A shaft 54 extends parallel to the baseplate 48 and is located midway between the supports 50 paralleling the curved members 34 and 36. Two cams 56 are located near the ends of the shaft 54 directly below the positions of the straight members 38 and 40. A handle 58 is attached to the shaft 54 to manually control its rotational position. Two cam limit stops 60, which contact two screws 62 that extend up through the baseplate 48, are attached to the shaft 54 to limit the amount of shaft and cam rotation. Two other screws 64, which extend up from the baseplate 48, contact two of the supports supports 50 to provide means for varying tension in the mask 24. Also included, is a vacuum chuck 66, shown partially broken away above the remainder of the fixture 46. The vacuum chuck 66 has a curved surface which is identical to the finished mask and supports the mask until the mask is welded to the frame.

In beginning the assembly process, the four clamps 52 are loosened. Next, two subassemblies are placed in the supports 50. Each subassembly comprises one curved member, 34 or 36, and two parts, 42 or 44, of the straight members 38 and 40. The clamps 52 are then tightened to hold the curved members 34 and 36. The handle 58 is now rotated so that the straight member parts 42 and 44, which are supported by the cams 56, rotate downwardly approximately 5 degrees. At this time, the vacuum chuck 66 supports the shadow mask 24 against the curved members 34 and 36. Next, the mask 24 is welded to the curved members 34 and 36, the vacuum chuck 66 is removed from the fixture and the screws 64 are adjusted to provide a predetermine level of tension. Thereafter, the handle 58 is rotated to move the cams 56 against the straight member parts 42 and 44 to bring these parts into a parallel relationship. This rotation causes the curved members 34 and 36 to rotate and thereby tension the mask 24. At this time, the straight member parts 42 and 44 are welded together, thereby completing the assembly process.

The center of rotation of the curved members 34 and 36 is through the center of the ends of each of the members. Because the members 34 and 36 are curved, during rotation of the members, the apex of each of the members travels a greater distance than do its ends. Therefore, some function is required that will provide uniform mask tension. This function is provided in the novel frame by the torsional spring of the curved members, by the strength of the curved members and by the ability to adjust the tension at the ends of the curved members.

A mask-frame assembly, constructed as described above, is about 29% of the weight of prior assemblies used with cylindrical faceplate panels. This weight reduction comes from the use of a lighter frame which, preferably, is made with hollow tubes, for the curved members 34 and 36, and overlapped L-shaped arms, for the straight members 38 and 40.

What is claimed is:

1. In a method of assembling a tensioned shadow mask and support frame, said mask being rectangular having two long sides paralleling a central major axis thereof and two short sides paralleling a central minor axis thereof, said frame having two curved members paralleling said major axis and two straight members paralleling said minor axis, the two long sides of said mask being welded to said curved members, the improvement comprising forming two subassemblies of said frame, each subassembly including one of said curved members and two partial straight members, each partial straight member being attached to an end of the curved member, clamping said two subassemblies in approximately their final positions with respect to each other with the partial straight members on each side of the frame overlapping each other, rotating said subassemblies to form an angle between the overlapped partial straight members, the angle being less than 180 degrees on the side of the frame of the intended mask attachment, positioning said mask on said frame with the long sides of said mask being on said curved members, welding the long sides of said mask to said curved members, rotating said subassemblies in a direction opposite to the first rotation to apply tension to said two curved members to place at least a central portion of said shadow mask under a predetermined tension, applying pressure to the ends of one of said curved members in a direction away from the other curved member to place at least the side portions of said shadow mask under said predetermined tension, and welding the partial straight members together where they overlap to form complete straight members extending between said curved members.

2. In a method of assemblying a tensioned shadow mask and support frame, said mask being rectangular having two long sides paralleling a central major axis thereof and two short sides paralleling a central minor axis thereof, said frame having two curved torsion tubes paralleling said major axis and two tension arms paralleling said minor axis, the two long sides of said mask being welded to said torsion tubes, the improvement comprising forming two subassemblies of said frame, each subassembly including one of said torsion tubes and two partial tension arms, each partial tension arm being attached to an end of the torsion tube, clamping said two subassemblies in approximately their final positions with respect to each other with the partial tension arms on each side of the frame overlapping, rotating said subassemblies to form an angle between the overlapped partial tension arms, the angle being less than 180 degrees on the side of the frame of the intended mask attachment, positioning said mask on said frame with the long sides of said mask being on said torsion tubes, welding the long sides of said mask to said torsion tubes, rotating said subassemblies in a direction opposite to the first rotation to apply tension to said two torsion tubes to place at least a central portion of said shadow mask under a predetermined tension, applying pressure to the ends of one of said torsion tubes in a direction away from the other torsion tube to place at least the side portions of said shadow mask under said predetermined tension, and welding the partial tension arms together where they overlap to form complete tension arms extending between said torsion tubes.

* * * * *